United States Patent [19]

Dazzi et al.

[11] Patent Number: 4,462,369

[45] Date of Patent: Jul. 31, 1984

[54] FUEL INJECTION APPARATUS DESIGNED FOR AN INTERNAL-COMBUSTION ENGINE

[75] Inventors: Jean-Louis Dazzi, Saint Genis Laval; Jean-Louis Froment, Lyons, both of France

[73] Assignee: Renault Vehicules Industriels, Lyons, France

[21] Appl. No.: 216,333

[22] Filed: Dec. 15, 1980

[30] Foreign Application Priority Data

Dec. 14, 1979 [FR] France ..... 79 31353

[51] Int. Cl.[3] ..... F02B 19/00; F02M 59/00

[52] U.S. Cl. ..... 123/450; 123/458; 123/451; 137/885

[58] Field of Search ..... 123/450, 457, 458, 459, 123/460, 451, 467, 456; 137/883, 885, 627

[56] References Cited

U.S. PATENT DOCUMENTS 3,416,506 12/1968 Steiger ..... 123/467
3,530,884 9/1970 Kutz ..... 137/885
3,851,635 12/1974 Murtin ..... 123/472
4,185,779 1/1980 Watson ..... 123/472

*Primary Examiner*—Charles J. Myhre
*Assistant Examiner*—Carl Stuart Miller
*Attorney, Agent, or Firm*—Remy J. VanOphem

[57] ABSTRACT

A fuel injection apparatus for controlling fuel injectors for internal combustion engines which injectors remain normally shut as a result of a high fuel pressure applied on either side of injector fuel nozzles. The apparatus of the present invention includes a first slide valve member which, by sliding from one extreme position to another, is able to lower the pressure below a fuel nozzle associated with a fuel injector to start a fuel injection cycle in that injector. The apparatus also includes a second slide valve member which, by sliding from one extreme position to another, is able to increase the pressure below the fuel nozzle to end the fuel injection cycle and control the duration of the fuel injection cycle as well as the flow rate of the injected fuel. The first and second slide valve members return to their initial positions after two consecutive fuel injection cycles.

6 Claims, 7 Drawing Figures

FUEL INJECTION APPARATUS DESIGNED FOR AN INTERNAL-COMBUSTION ENGINE

FIELD OF THE INVENTION

The present invention pertains to a fuel injection apparatus designed for an internal-combustion engine.

BACKGROUND OF THE INVENTION

Presently, most industrial diesel engines are equipped with mechanical injection devices. Most mechanical fuel injection devices use a piston type, mechanical pump which causes an injector nozzle valve to open under the increased pressure applied thereto. The fuel injection ends as the pressure drop allows the injector nozzle valve to return on its seat by means of a suitable return spring.

The beginning and the end of the fuel injection spray from the injector nozzles are, therefore, dependent upon the selective control of pressure in an hydraulic system, as well as upon the interaction of the injector nozzle valve return spring.

Such prior art mechanical fuel injection devices, known for their sturdiness and reliability, are, however, limited in their performance when an improved combustion is required. When using the prior art mechanical pumps, it is indeed difficult to accurately monitor and control the duration of an injection cycle and the fuel spray pressure.

In addition the accurate monitoring of the beginning or timing of the fuel injection spray cycle and the regulation of injected flow depends on engine speed, the ambient conditions, and the engine condition (coolant temperature for instance) which parmeters become very important with the prior art injection means.

The present invention is directed to a new fuel injection apparatus providing all injection monitoring devices that are not normally included in the prior art injection systems, or that are included therein at the cost of a greater complexity.

In the field of fuel injection, it is well known that fuel spray injector require the pressurization of fuel, as well as an electromechanical or hydraulically controlled slide valve so as to deliver the high pressure fuel to a fuel spray injector. In these prior art devices, only one controlled slide valve controls the beginning and the end of the fuel spray injection, and the occassionally flow regulation (by fuel controlling the opening duration).

In these known devices, the slide valve is fed by an electronic power station which operates according to the various parameters affecting the fuel spray injection. However, it is very difficult, if not impossible to control the timing off the start and the end of the fuel spray injection cycle as well as the regulation of the fuel flow, using a single slide valve, because of the great accuracy required in controlling these parameters during a very short period of time. It should be remembered that the fuel spray injection cycle duration on a truck diesel engine lasts about thirteen ten thousands of a second (0.0013) at full speed and about three thousands of a second (0.003) at a maximum torque. At full speed, the time period separating the start and end of the fuel spray injection is approximately five hundredths of a second (0.05). The required accuracy is then less than one tenth of a millisecond (0.1 msec) that is, roughly one sexagesimal degree of the rotation angle of the drive wheel or flywheel.

SUMMARY OF THE INVENTION

The primary purpose of this invention is to use a dual slide valve system to solve the above identified problems.

The present invention requires the use of a first slide valve member to control beginning of the fuel spray the injection, and of a second to control the end of the fuel spray injection.

The fuel spray injector used in the present invention is of the classical type. The injector nozzle is subject to the same fuel pressure on either side of the nozzle, that is, the pressure being generated by a high pressure pump. This high pressure amounts to about one thousand bars (1000). The opening of the regulating valve causes a pressure drop below the fuel spray injector nozzle during the required time, which defines both the timing of the injection start and the fuel flow control.

The fuel injection apparatus of the present invention calls for the use of hydraulic pump with a relatively low output (0.25 to 2 liters per minute) under high pressure (1000 to 2000 bars). Such pumps are known in the prior art.

As previously discussed by the present invention consists of the use of a slide valve system. It is very difficult to control an electromechanical or hydraulically controlled slide valve in such a short time as one and three tens to three milliseconds (1.3 to 3), while obtaining an accuracy which is less than one tenth of a millisecond (0.1).

The advantages of a dual slide valve system are as follows: one slide valve member provides the discharge at the back of the injector, thus causing the start of the fuel spray injection cycle without considering any other factors, through a displacement of the injector nozzle (opening the injector); another slide valve member controls the end of the fuel spray injection cycle, regardless of the other factors, or parameters the injected fuel spray flow is regulated by the nozzle seat displacement under the action of the fuel pressure on either part of the injector nozzle.

The fuel spray flow is therefore regulated by the dephasing between the motions of both slide valve members.

The apparatus according to the present invention essentially offers three advantages.

First, the injected fuel spray flow does not pass through a regulating valve.

Second, the nozzle seat determines the end and the beginning of the fuel spray injector through a pressure decrease and increase applied to a small volume of oil in the slide valve. This allows for a miniaturization of the electro-valves (including 4 milimeter diameter bores, and 1 millimeter diameter drain outlets for instance).

Third, the slide valve and the injector nozzles eliminate the return spring and the noisy operation of the weight-spring systems Furthermore, the slide valves are no longer subjected to a backward and forward motion during the time of the fuel spray injection cycle. Therefore, the first slide valve member remains in the open position as the second slide valve member controls the end of the injection. During the subsequent fuel spray injection cycle, the slide valve members move suquentially but in the reverse direction as compared to their previous displacement, and only then recover their initial positions.

Thus, the slide valve operating delays no longer present a problem.

In the present apparatus, the fuel flow is soley regulated by the dephasing of both slide valve motions. Only one fuel dual slide valve assembly is consecutively connected to one injector by means of a rotary distributor in the order of ignition of the engine.

The slide valves are controlled by electro-magnets, or one hydraulically controlled by electromechanical or hydraulically controlled slide valves.

The power is fed from an electronic power station or control unit which delivers the control power. This power station or controller receives the required data from prior art receivers, or sensors that is: a magnetic receiver located on the engine flywheel and which records the piston's position, a coolant temperature gage or sensor, a thermometer or temperature sensor recording the temperature of the atmosphere, a pressure gage or pressure sensor recording the atmospherical pressure or the discharge pressure of the compressor, as well as other receivers or sensors.

Such electronic power stations or control unit are already being used and are, therefore, not part of the invention.

The apparatus designed according to the specifications of the invention may, for instance, measure the following parameters and make the following adjustments:

| Parameters | Results |
|---|---|
| Air temperature | Pump discharge Adjustment |
| Atmospheric or compressor discharge pressure | Pump discharge Adjustment |
| Engine speed | Beginning of the fuel injection period-discharge |
| Angle recording | Beginning of the fuel injection period-discharge |
| Acceleration | Discharge-Advance |

It is therefore necessary to determine the operational algorithm which will define the output with reference to the output.

The mircoprocessor or calculator may be obtained from most commercial sources.

The many objects, features and advantages of the present invention will be apparent to those skilled in the art when the following detailed description is read together with the schematic drawings attached hereto.

DETAILED DESCRIPTION OF THE PREFERRED EMBODIMENT

Figure 1:
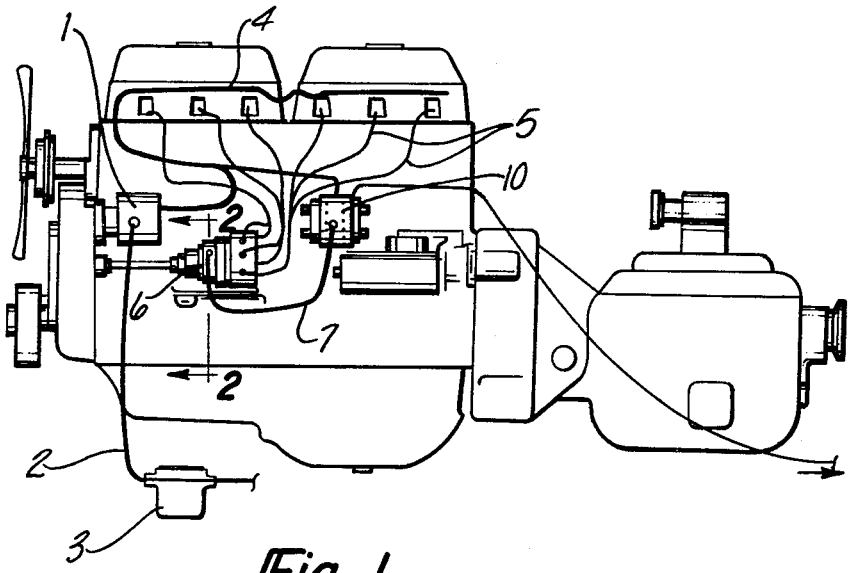
FIG. 1 is a side view of an engine which is equipped with the electronic fuel injection apparatus according to the invention.

As shown in FIG. 1, a high pressure pump 1, which can raise the pressure of the diesel oil to about 1000 bars, is activated by the engine, for example by means of a connection to the distributor plate. The pump 1 receives the diesel oil from a pipe 2 connected to the tank, by means of the usual filters and priming pumps which are schematically indicated by reference numeral 3. The pump 1 directly feeds the series of injectors through a tube 4. When not controlled, the injectors do not cause any discharge, since each of their nozzles is pressure fed from below by means of a pipe 5. The pipes 5 originate in a rotary distributor 6 which is more clearly shown in FIGS. 2 and 3. A rotor 11 of the distributor 6 is driven at a speed which, in the case of a four-stroke engine, is half of the crankshaft speed. The connection order for the pipes 5 leading to the injectors is the same as the ignition sequence of the cylinders associated therewith in FIG. 2, a hole 8 is provided in the rotor 11 which feeds an axial duct 9. The duct 9 connects the distributor 6 to the dual slide valve assembly 10 by means of a circular groove 34, illustrated in FIGS. 2 and 3, and a pipe 7, shown in FIG. 1.

Figure 4:
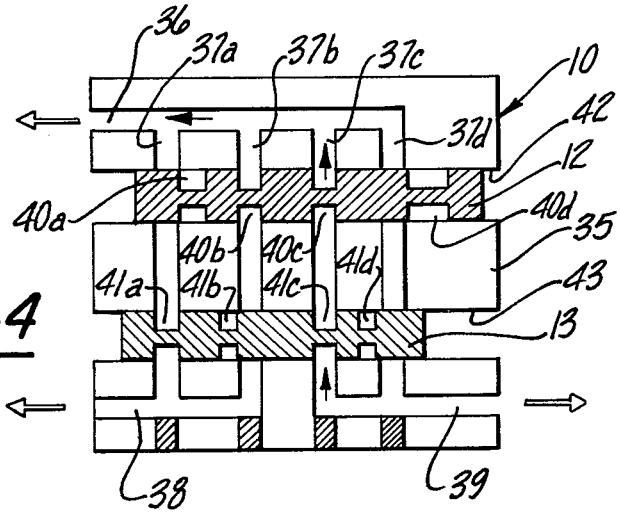
FIGS. 4 through 6 depict longitudinal sectional views of a dual slide valve of the injection apparatus, and illustrate consecutive operating phases thereof.
Figure 5:
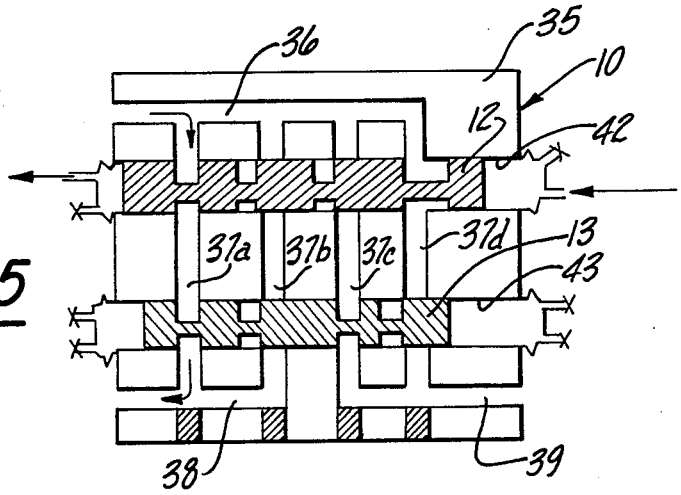
Figure 6:
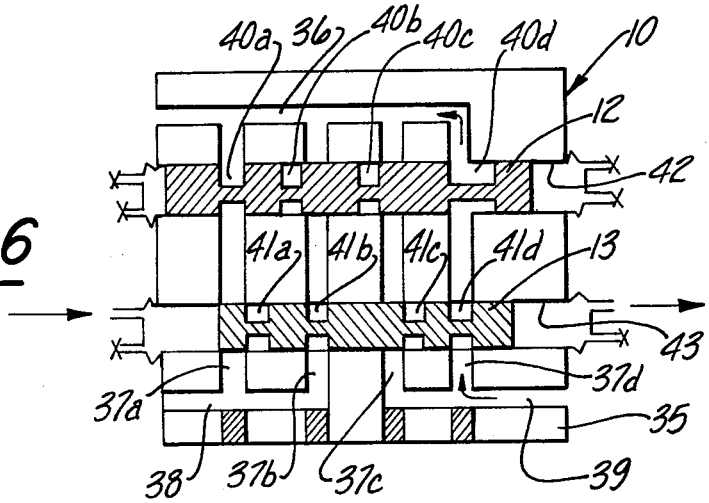

The slide valve assembly 10 is shown in FIGS. 4, 5, 6 in three relative positions of the slide valve members 12 and 13. The slide valve assembly 10 includes a valve block 35 having various passageways formed therein. A first passageway 36 is interconnected with the injector. Another passageway 38 is interconnected with the reservoir. A final passageway 39 is interconnected with the pump. Between the passageway 36 and the other passageways 38 and 39 are two bores 42 and 43. The slide valve members 12 and 13 are slidably disposed in the bores 42 and 43 respectively. Four passageways 37*a*, 37*b*, 37*c* and 37*d* are provided through the valve block 35. The passageways 37*a* and 37*b* each extend across the bores 42 and 43 and interconnect the passageway 36 with the passageway 38. Similarly, the passageways 37*c* and 37*d* cross the bores 42 and 43 and interconnect the passageways 36 and 39. The slide valve members 12 and 13 are each provided with annular passageways 42*a* through 42*d* and 41*a* through 41*d*, respectively, to selectively open and close the passageways 37*a* through 37*d* through the valve block.

When the slide valve members are in the position illustrated in FIG. 4, only the passageway 37*c* is opened permitting fuel flow from the pump to the injector. The passageway 37*a* is closed by the first slide valve member 12. The passageway 37*b* is closed by the second slide valve member 13. The passageway 37*d* is also closed by the second slide valve member 13. Therefore, when the slide valve members 12 and 13 are in the position shown in FIG. 4, pressure will be supplied below the fuel nozzle to prevent injection of fuel.

When the slide valve members are in the positions shown in FIG. 5, only the passageway 37*a* will be open so that so that the reservoir will be in fluid communication with the injector but not with the pump. Pressure will drop below the fuel nozzle and an injection cycle will begin.

When the slide valve members 12 and 13 are in the positions shown in FIG. 6, only the passageway 37*d* will be open. This will create a condition similar to that created by the orientation illustrated in FIG. 4. Similarly, in a fourth orientation, not illustrated in the drawing, wherein both of the slide valve members 12 and 13 are shifted to the right as shown in FIGS. 4 through 6, only the passageway 37*b* will be open creating a condition similar to that illustrated in FIG. 5.

Before the ignition of a given cylinder, the rotary distributor 6 connects an injector to a dual slide valve assembly of the type illustrated in FIG. 4. As long as that slide valve remains shut, that is as long as both slide valve members 12 and 13 remain inactivated, nothing is changed. At the precise moment when fuel injection into the engine should occur, the first slide valve member 12 moves to the left under the effect of the force applied by a hydraulic control pressure supplied by an electro-valve. The electro-valve is controlled by an electronic microprocessor which will be described later. In its new position, the slide valve member 12 drains the pipe 5 of the respective injector. Below the respective injection nozzle, the drawing of the pipe 5 causes a pressure drop which in turn causes a displacement of the nozzle seat, as well as the start of the injection of fuel into the engine.

Thus, the fuel spray injection cycle is started and continues until the second slide valve member 13 moves to the right in FIG. 6 (as viewed in FIG. 6) under an hydraulic pressure delivered by an electro-valve which, in turn, is controlled by the above mentioned electronic microprocessor. The displacement the second slide valve member 13 reestablishes the pressure in the pipe 5 of the respective injector, so that the lower face of the injector nozzle seat is subjected to a pressure which brings it back in an injector shutting position, that is, the fuel spray end of the injection cycle.

The slide valve members 12 and 13 then remain in their new position, and only return to their initial position after they control another fuel spray injection cycle in another cylinder. Thus, these slide valve members never complete a backward and forward motion during a single fuel spray injection cycle, but a single back or forth motion instead each move in a single backward and forward motion for each injection cycle. This feature allows for quick operational cycles, while retaining a good accuracy.

Figure 7:
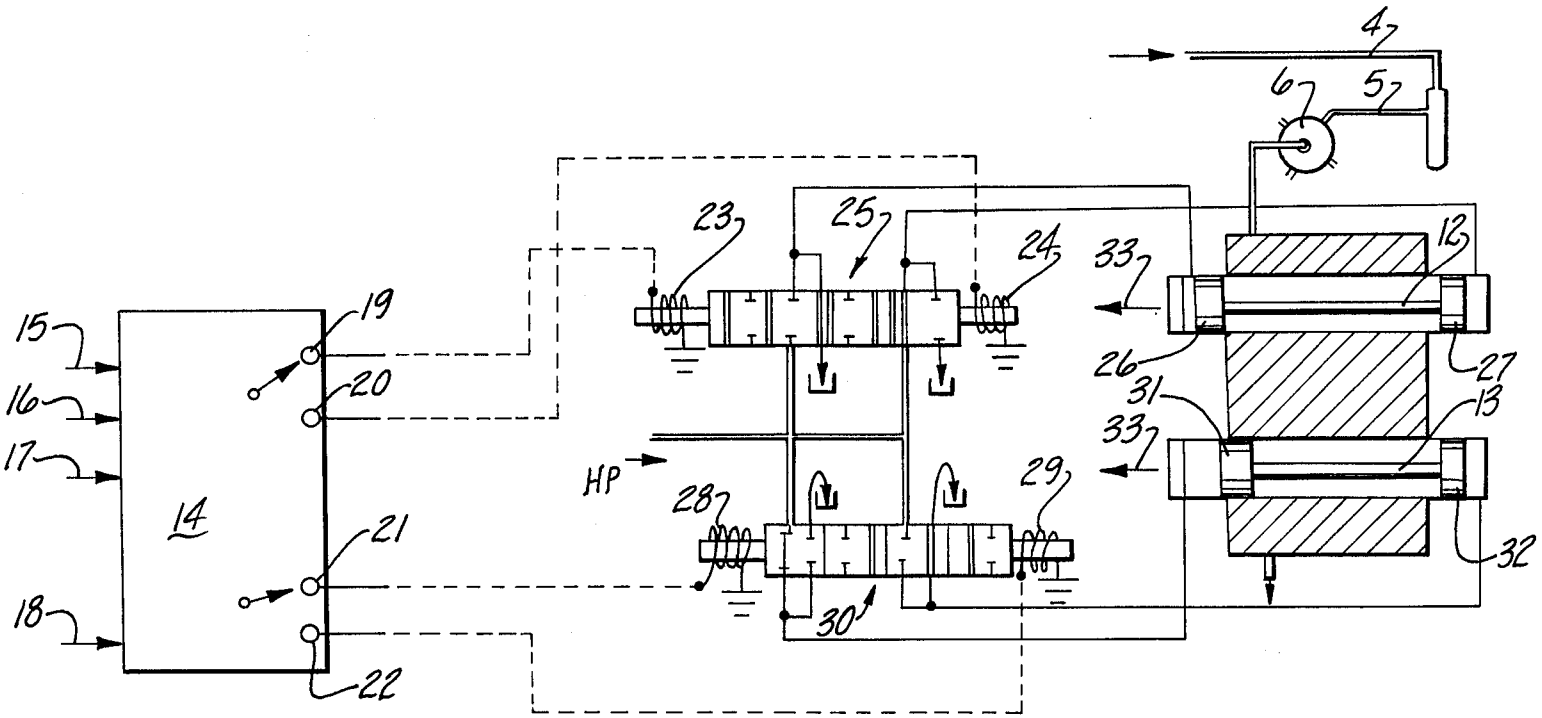
FIG. 7 is a schematic view of the electronic fuel injection apparatus of the present invention

FIG. 7 illustrates the connection of the above mentioned microprocessor. In addition to the magnetic receiver or sensor located on the engine flywheel which provides the position of each piston, this microprocessor includes four input terminals 15 through 18 which are connected to classical receivers or sensors in order to record the various information required for the operation.

A terminal 15 is connected to a pressure gage recording the atmospheric or compressor discharge pressure or the pressure generated by the high pressure pump 1.

A terminal 16 is connected to a thermometer or temperature sensor which records the outside temperature.

A terminal 17 is connected to a thermometer or temperature sensor which records the coolant temperature.

A terminal 18 is connected to a receiver which records the data transmitted by the operator.

The microprocessor 14 also includes four output terminals 19, 20, 21 and 22. Through the terminals 19 and 20, it may be supplied with the required power to control spools 23 and 24 of a micro-electro-valve or electromechanical valve 25 which controls the fuel flow feeding of control cylinders 26 and 27 of the first slide valve member 12. By means of the output terminals 21 and 22, the microprocessor 14 may feed the required electrical power to control spools 28 and 29 of a micro-electro-valve or electromechanical valve 30 which controls the fuel flow into control cylinders 31 and 32 of the second slide valve member 13.

Therefore, from the data received through the input terminals 15 through 18, and on the basis of a predetermined operational algorithm, the microprocessor controls both the starting time and the duration of fuel injection for each injection cycle.

It has been explained that, upon each injection, the slide valve members 12 and 13 each only complete a single backwards or forward motion. Therefore, as an injection occurs by means of control flows sent by the output terminals 19 and 21 to the spools 23 and 28 in order to activate the cylinders 27 and 32, and consecutively displace the slide valve members 12 and 13 in the direction indicated by arrows 33, the following injection is caused by control flows which are sent from the output terminals 20 and 22 so as to define a reverse displacement of the slide valve members 12 and 13.

Having thus described the present invention by means of a detailed description of the preferred embodiment, variations and modifications wherefrom will be apparent to those skilled in the art, what is claimed as novel is as follows:

1. A fuel injection control apparatus for an internal combustion engine having a source of pressurized fuel, a fuel reservoir and at least one fuel injector having a portion normally interconnected with said source of pressurized fuel and selectively operable in inject fuel in response to a predetermined decrease of pressure in said portion of said at least one fuel injector, said fuel injector control apparatus comprising:

a valve body;

a first passageway means formed in said valve body and interconnectable with said portion of said at least one fuel injector;

a second passageway means formed in said valve body and interconnectable with said source of pressurized fuel;

a third passageway means formed in said valve body and interconnectable with said fuel reservoir;

a fourth passageway means and a fifth passageway means each formed in said valve body and each interconnecting said first and second passageway means;

a sixth passageway means and a seventh passageway means each formed in said valve body and each interconnecting said first and said third passageway means;

first valve means crossing each of said fourth, fifth, sixth and seventh passageway means and reciprocating thereacross between a first position opening said fifth and sixth passageway means and closing said fourth and seventh passageway means and a second position opening said fourth and seventh passageway means and closing said fifth and sixth passageway means; and second valve means crossing each of said fourth, fifth sixth and seventh passageway means and reciprocating between a first position opening said fifth and seventh passageway means and closing said fourth and sixth passageway means and a second position opening said fourth and sixth passageway means and closing said fifth and seventh passageway means such that, when both of said first and second valve means are in said first positions, said first passageway means is interconnected with said second passageway means and is disconnected from said third passageway means, and further such that when both of said first and second valve means are in said second positions, said first passageway means is interconnected with said second passageway means and is disconnected from said third passageway means, and still further such that when one of said first and second valve means is in its first position and the other of said first and second valve means is in its second position, said first passageway means is disconnected from said second passageway means and is interconnected with said third passageway means.

2. The fuel injection control apparatus of claim 14, wherein said first and second valve means are each displaced between said first and second positions in response to hydraulic signals.

3. The fuel injection control apparatus of claim 2, wherein said hydraulic signals are generated by electromechanical valve means in response to electrical signals indicative of the beginning and end of each fuel injection operation.

4. The fuel injection control apparatus of claim 1, wherein said first and second valve means are each electromagnetically displaced between said first and second positions in response to electrical signals indicative of the beginning and the end of each fuel injection operation.

5. The fuel injection control apparatus of claim 3, wherein said electrical signals are generated by an electronic microprocessor in response to the operating parameters of said internal combustion engine and orders received from an operator.

6. The fuel injection control apparatus of claims 3 or 4 wherein said internal combustion engine further comprises sensors generating signals indicative of the operating parameters of said internal combustion engine and further wherein said fuel injection control apparatus further comprises a microprocessor for generating said electrical signals in response to signals received from said sensors, said electrical signals further being indicative of the beginning and the end of the injection operation for said at least one fuel injector.

* * * * *

UNITED STATES PATENT AND TRADEMARK OFFICE

CERTIFICATE OF CORRECTION

PATENT NO. : 4,462,369

DATED : July 31, 1984 Sheet 1 of 3

INVENTOR(S) : Dazzi, et al.

It is certified that error appears in the above-identified patent and that said Letters Patent is hereby corrected as shown below:

Column 1, line 55, delete "off" and insert ---- of ----.

Column 2, line 9, delete "the" second occurrence.

Column 2, line 10, after "second" insert ---- slide valve member ----.

Column 2, line 22, before "hydraulic" insert ---- a ----.

Column 2, line 26, after "discussed" insert a comma ---- , ----. Same line, delete "by".

Column 2, line 40, delete ", or parameters" and insert ---- or parameters. Therefore, ----.

Column 2, line 52, after "spray" insert ---- from the ----.

UNITED STATES PATENT AND TRADEMARK OFFICE

CERTIFICATE OF CORRECTION

PATENT NO. : 4,462,369

DATED : July 31, 1984

INVENTOR(S) : Dazzi, et al.

It is certified that error appears in the above-identified patent and that said Letters Patent is hereby corrected as shown below:

Column 2, line 57, delete "valve" and insert ---- valves ----.

Column 2, line 59, after "systems" insert a period ---- . ----.

Column 3, line 3, delete "soley" and insert ---- solely ----.

Column 3, line 5, delete "fuel".

Column 3, line 6, after "one" insert ---- fuel ----.

Column 3, line 22, delete "unit" and insert ---- units ----.

Column 3, before line 44, insert the title ---- BRIEF DESCRIPTION OF THE DRAWINGS ----.

Column 3, line 56, delete "and" second occurrence.

Column 3, line 61, after "invention" insert a period ---- . ----.

Column 4, line 13, after "therewith" insert a period ---- . ----.

Figure 2:
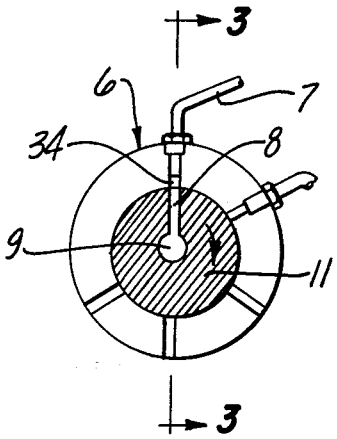
FIG. 2 is a cross-sectional view taken along line II—II of FIG. 1 and illustrating the rotary distributor of the electronic fuel injection apparatus of the present invention.
Figure 3:
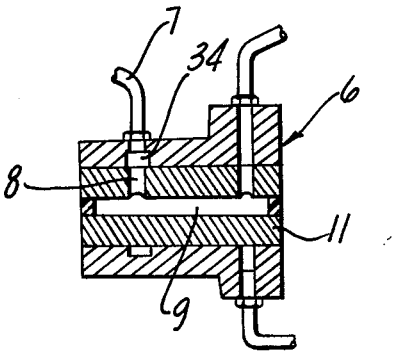
FIG. 3 is a sectional view taken along line III—III of FIG. 2 and illustrating the rotary distributor.

Column 4, line 14, before "in fig. 2" insert ---- As indicated ----.

Column 4, line 19, delete "5,6" and insert ---- 5 and 6 ----.

Column 4, line 53, delete "so that" first occurrence.

Column 5, line 20, after "displacement" insert ---- of ----.

UNITED STATES PATENT AND TRADEMARK OFFICE

CERTIFICATE OF CORRECTION

PATENT NO. : 4,462,369

DATED : July 31, 1984 Sheet 3 of 3

INVENTOR(S) : Dazzi, et al.

It is certified that error appears in the above-identified patent and that said Letters Patent is hereby corrected as shown below:

Column 5, line 31, delete "a single back or".

Column 5, line 32, delete "forth motion".

Column 5, line 33, delete "and" and insert ---- or ----.

In the Claims

Column 6, line 52, after "fifth" insert a comma ---- , ----.

Column 7, line 7, delete "14," and insert ---- 1, ----.

Column 8, line 11, after "engine" insert a semicolon ---- ; ----.

Signed and Sealed this

*Ninth* Day of *April 1985*

[SEAL]

*Attest:*

DONALD J. QUIGG

*Attesting Officer* *Acting Commissioner of Patents and Trademarks*